US005865181A

United States Patent [19]

Spence, Jr.

[11] Patent Number: 5,865,181

[45] Date of Patent: Feb. 2, 1999

[54] MEDICAL POST OPERATION RECOVERY DEVICE

[76] Inventor: Royall H. Spence, Jr., 105 Kemp Rd. East, Greensboro, N.C. 27410

[21] Appl. No.: 905,523

[22] Filed: Aug. 4, 1997

[51] Int. Cl.[6] ..... A61G 15/00

[52] U.S. Cl. ..... 128/845; 128/846; 5/637; 5/638

[58] Field of Search ..... 128/845, 846, 128/869, 870, 857, 858; 5/636, 637, 638

[56] References Cited

U.S. PATENT DOCUMENTS

| | | | |
|---|---|---|---|
| 2,239,003 | 4/1941 | Jones | 5/638 |
| 2,803,022 | 8/1957 | Wynkoop | 5/638 |
| 3,140,497 | 7/1964 | Carswell | 5/638 |
| 3,828,377 | 8/1974 | Eary | 5/638 |
| 4,504,050 | 3/1985 | Osborne | 5/637 |
| 4,752,064 | 6/1988 | Voss | 269/328 |
| 4,823,776 | 4/1989 | Foster | 5/638 |
| 4,995,378 | 2/1991 | Dyer et al. | 128/75 |
| 5,007,122 | 4/1991 | Daughdrill | 5/434 |
| 5,435,323 | 7/1995 | Rudy | 128/870 |
| 5,520,623 | 5/1996 | Williams | 602/17 |

*Primary Examiner*—Michael A. Brown

[57] ABSTRACT

The invention herein provides an inclined recovery device for a patient's upper body and an aperture so that a prone patient will still have a broad field of vision when lying thereon. The device is well suited to holding a person's head in a stable position as required when recovering from eye surgery.

16 Claims, 3 Drawing Sheets

MEDICAL POST OPERATION RECOVERY DEVICE

BACKGROUND OF THE INVENTION

1. Field of the Invention

This invention relates to an apparatus which functions to support the upper portion of the human body in a prone position for selected extended periods of time, for example, during convalescence from eye surgery.

2. Description of the Prior Art and Objectives of the Invention

Individuals may prefer to be prone for any of a number of different reasons. Perhaps the most important need occurs during or following some types of surgery. The patient is required to remain in a prone position during certain types of surgical procedures, such as orthopedic back surgery. A number of therapeutic devices have been devised which provide support for the body in a prone position and some of these devices also serve to immobilize the head.

A somewhat different set of requirements is imposed on patients recovering from certain types of surgical procedures performed on the eye such as a macular surgery, as may be needed for macular degeneration, or a detached retina. In order to allow certain tissues to reattach properly to the interior of the eyeball, it is necessary for the recovering patient to remain in a prone position with the head stabilized during a period of approximately three weeks following surgery. Due to cost-containment considerations, it is customary for the patient to spend this period of convalescence at home. These surgeries are usually performed on older individuals and reflux, or fluid traveling from the stomach to the mouth, is a concern, especially for individuals resting on their stomachs.

These inactivity standards place psychological as well as physical stress on the patient. Even if the patient is physically comfortable, sheer boredom can make it extremely difficult for the patient to remain in a prone position for the required periods of time. Unfortunately, if the patient turns his head frequently, for example, to read or watch television, proper tissue reattachment may not occur. This may result in the need for a second operation or total vision loss in extreme cases.

Therefore, a therapeutic post operation upper body support device is needed which 1) provides for proper distribution of weight of the head and upper body while the patient is in the prone position with face downwards; 2) allows the patient to read or watch television as desired; 3) is portable for use in the home; 4) is inclined to prevent reflux; 5) allows the patient to touch, clean or scratch his face as needed without over-extending the arms; 6) allows air to circulate freely under the patient; and 7) is comfortable enough to be used in excess of 12 hours a day. Portability allows the device to be rented and returned after use, thus helping to meet the goal of cost-containment.

Certain devices provided by the prior art meet some, but not all, of the above requirements. For instance, U.S. Pat. No. 4,752,064 includes a pillow device provided with a T-shaped void through which the patient in a prone position may observe a television monitor during a surgical procedure in a hospital environment. Other prior art devices provide proper support for the head, but cover the eyes of the patient such as in U.S. Pat. No. 3,828,377. Thus, a need exists for a device meeting all of the features reiterated above.

A primary object of the invention is to provide an inclined upper body support device for supporting the head and upper body in a prone position on a bed with the face down.

Another object of the invention is to allow the user to view objects such as a book in order to be entertained while recuperating face down.

Still another object of the invention is provide such a device which is portable, so that it may be easily carried and used in the home on a temporary basis.

Yet another object of the invention is to provide fastening for a moisture-absorbent towel or the like such that the towel does not block the user's field of vision while face down.

A further object of the invention is to provide an inclined support to prevent stomach reflux during prone recovery.

Another object of the invention is to provide a body support which allows the patient to freely touch his face without having to reach around a mattress or other obstruction.

Still another object of the invention is to provide a body support which allows air to freely circulate beneath the upper body of the patient for comfort during prone recovery.

Still further objects and advantages of the invention will become readily apparent to those skilled in the art to which the invention pertains upon reference to the following detailed description.

SUMMARY OF THE INVENTION

The foregoing and other objects are achieved in a relatively lightweight, portable device including a planar base, a facial support apparatus, a strut for inclining the base, and a fastening member serving the dual function of attaching the facial support apparatus to the base and clamping a moisture-absorptive material such as a towel, sheet, or the like between the facial support apparatus and the base. The moisture-absorptive material is positioned so as to leave unobstructed a field of view afforded by the base and the facial support apparatus.

BRIEF DESCRIPTION OF THE DRAWINGS

A preferred embodiment of a device according to the invention is depicted in the accompanying drawings, as follows.

DETAILED DESCRIPTION OF THE PREFERRED EMBODIMENT AND OPERATION OF THE INVENTION

Figure 1:
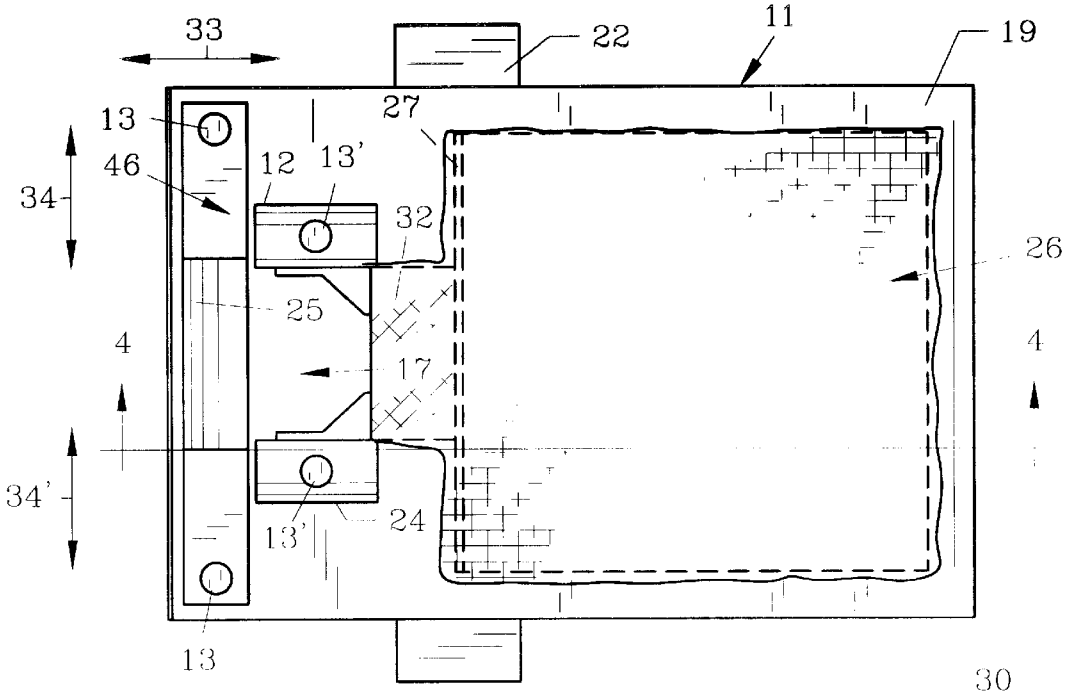
FIG. 1 shows a top plan view of a preferred embodiment of the inventive device.
Figure 2:
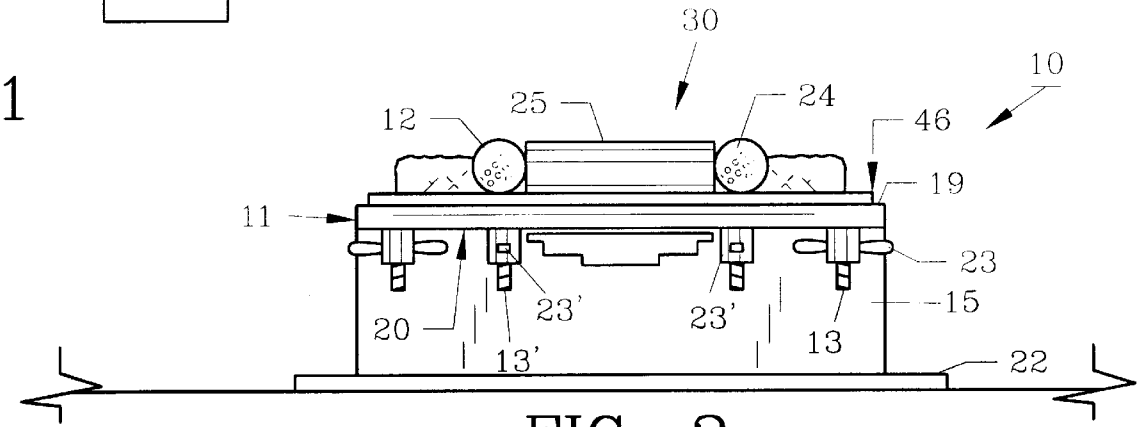
FIG. 2 depicts a front elevation of the device seen in FIG. 1.
Figure 5:
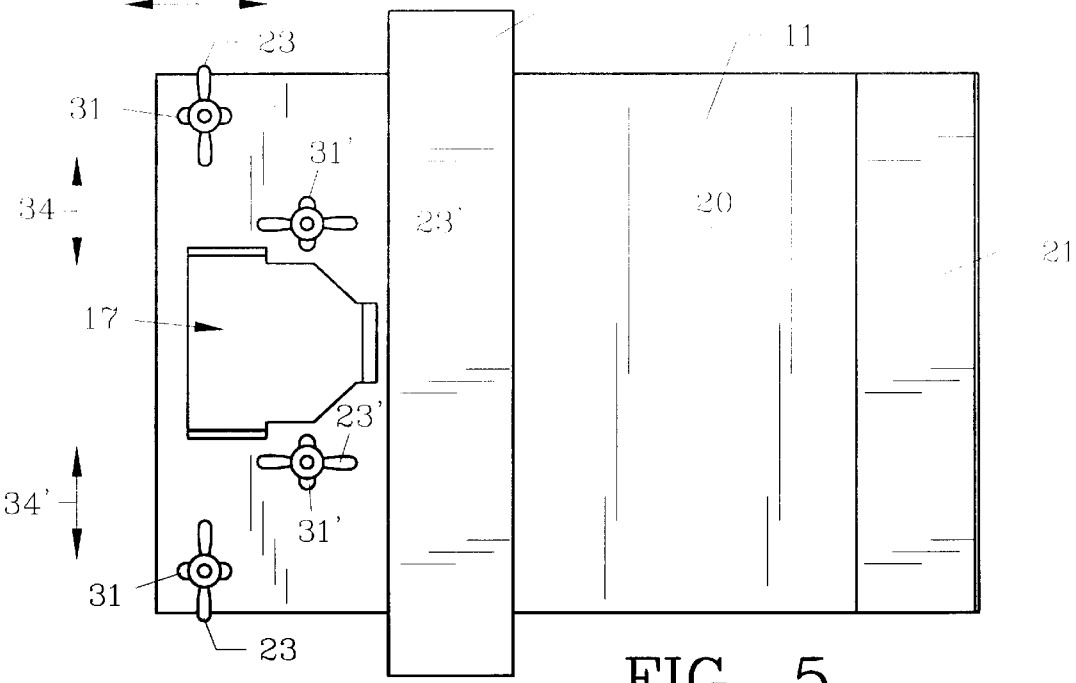

With reference to FIG. 1, medical post operation recovery device 10 is preferably comprised of planar base 11 having first top surface 19 and opposed bottom surface 20 (FIG. 2). Planar base 11 defines facial aperture 17 and a plurality of fastener slots 31, 31' (FIG. 5). Facial support 30 surrounds aperture 17. Mounted on planar base 11 is polyurethane foam pad 26 disposed beneath flexible moisture-adsorptive towel material 18 as seen in FIG. 1. Edges of plate 22 can be seen as plate 22 is wider than planar base 11. Post operation recovery device 10 may be made of plastic, wood, metal or combination thereof, along with other suitable, available materials.

Facial support 30 is comprised of side supports 12 and 24, forehead support 25 and chin support 32. In the preferred embodiment, each of supports 12, 24 and 25 is covered by a resilient material such as polyurethane foam, and may be covered by a cloth or plastic sheet. Other resilient materials such as foam rubber may also be used. Forehead support 25 is mounted on adjusting member 46 which is in turn mounted on planar base 11 by threaded fasteners 13 passing through fastener slots 31 in base 11 (seen better in FIGS. 2 and 5) Thus, adjusting member 46 can be moved as indicated by arrow 33 in FIG. 1 and tightened in place by wing nuts 23. Side supports 12 and 24 are likewise adjustably mounted on planar base 11 by threaded fasteners 13' passing through side support members 12 and 24 and through fastener slots 31' in planar base 11 (better seen in FIGS. 2 and 5) and tightened in place by wing nuts 23'. Chin support 32 is formed from an extended portion of polyurethane foam pad 27 which is disposed beneath polyurethane foam pad 26 which is in turn disposed beneath flexible moisture-absorbent material 18 (FIGS. 1 and 4).

Figure 3:
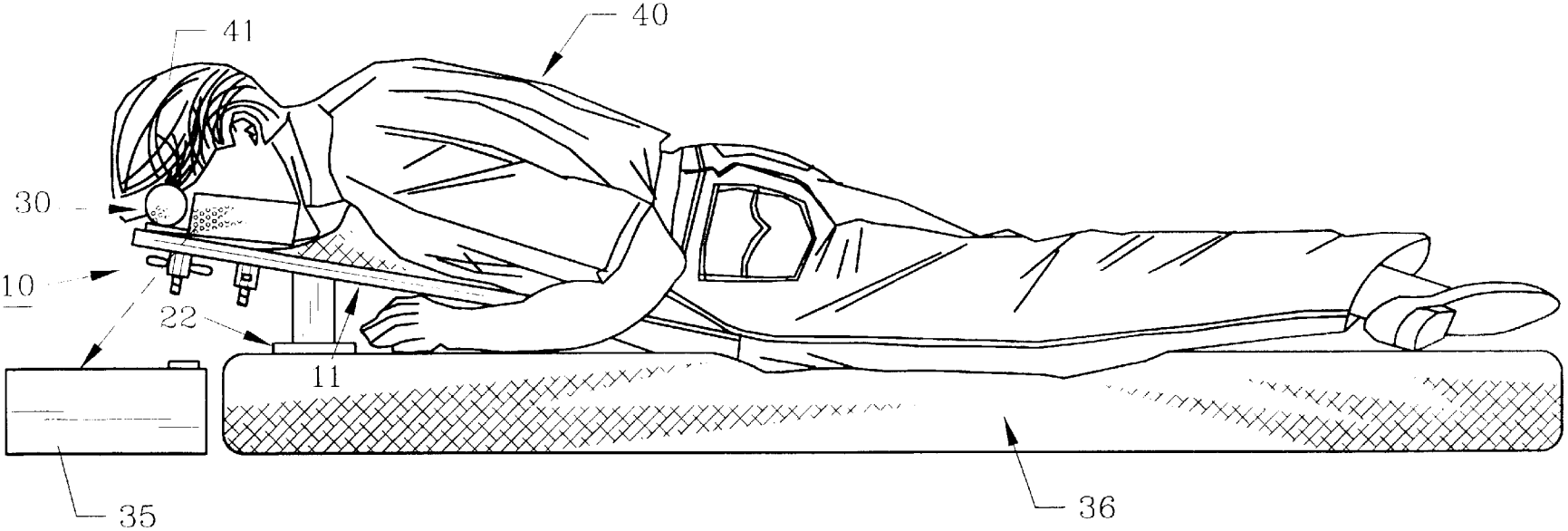
FIG. 3 illustrates a side elevation of the device with a patient thereon in normal use.

FIG. 2 shows facial support 30 mounted on planar base 11. Fasteners 13, 13' are preferably bolts and are received by wing nuts 23, 23', but it is within the scope of the present invention for screws or hex nuts or similar fasteners to be used. Strut 15 attached to plate 22 elevates one end of base 11 to a desired height for maintaining a field of vision through facial support 30. Plate 22 is wider than planar base 11 and extends past the sides thereof in order to prevent rotation of planar base 11 as when patient 40 (FIG. 3) using post operation recovery device 10 attempts to roll or turn in his sleep. Thus, plate 22 stabilizes planar base 11 even when placed on soft bed mattress 36 as seen in FIG. 3. The preferred recovery device 10 is relatively light in weight and weighs less than twenty-five pounds (approximately 11.4 kg.).

FIG. 3 further illustrates recovery device 10 in use. Specifically, patient 40 with head 41 rests in a prone position on mattress 36. The upper body of patient 40 rests on base 11 spaced therefrom by pads 26, 22 and towel 18. Head 41 is supported by facial support 30 in a face down posture and allows person 40 to see through aperture 17 to an object 35, such as a book or television, placed below head 41. In this manner, patient 40 can maintain a prone position, actively view object 35, breath effectively and stay in the desired face down position for extended periods of time. This field of vision is effectively increased by the inclination of base 11 caused by strut 15. Obviously, the inclination is limited by the comfort of patient 40, but a sufficient inclination is required in the preferred embodiment to allow air to circulate under base 11 and maintain the field of vision. Likewise, the inclination of base 11 allows patient 40 to see past edge of mattress 36 on a bed (not shown). In this manner, a larger object 35 such as a television can be placed in the field of vision just past the edge of mattress 36. In this manner, non-specialized mattresses or beds may be used, and recovery device 10 can be moved around as needed.

Figure 4:
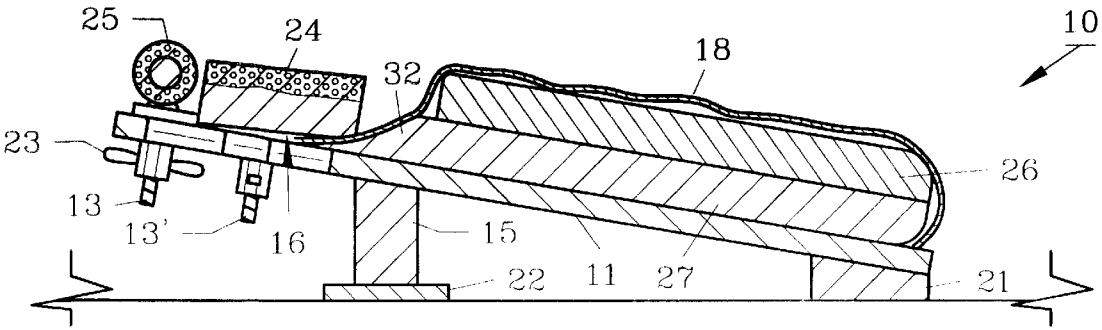
FIG. 4 features a cross-sectional view of the device taken along line 4—4 of FIG. 1; and, FIG. 5 is a bottom plan view of the device as seen in FIG. 1.

FIG. 4 depicts a cross sectional view of recovery device 10 and more clearly illustrates polyurethane foam pad 26 disposed beneath flexible moisture-adsorptive material 18. In the preferred embodiment, foam pad 26 rests on top of second polyurethane foam pad 27 and pads 26 and 27 may be attached to each other. The extended portion of pad 27 forms chin support 32 of facial support 30 as discussed above. Planar base 11 is seen supported by trapezoidal member 21 and strut 15 which is attached to plate 22. Flexible moisture-adsorptive material 18 such as terry cloth serves to draw moisture away from patient 40 lying on recovery device 10 for a long period of time. Flexible moisture-adsorptive material 18 can be a towel, sheet or similar device and is placed over foam pads 26, 27, but it is placed so as not to obstruct aperture 17. Over time, such flexible moisture-adsorptive material 18 tends to become bunched or shift its position in use if it is not secured. Such bunching may increase the discomfort of patient 40. Furthermore, it is difficult to remove flexible moisture-adsorptive material 18 while patient 40 remains in a prone position. The solution to this problem lies in the construction and nature of fasteners 13' and wing nuts 23'. Specifically, fasteners 13' attaching side supports 12 and 24 should be backed out of wing nuts 23' a sufficient degree to allow space as indicated generally by 16 in FIG. 4 between side supports 12, 24 and planar base 11. One end of flexible moisture-adsorptive material 18 is inserted in space 16 while draping the rest of moisture-adsorptive material 18 over foam pads 26 and 27. Fasteners 13' are tightened thereby clamping flexible moisture-adsorptive material 18 in place, and patient 40 assumes the prone position on the device. After use, fasteners 13' are loosened so that flexible moisture-adsorptive material 18 may be removed for cleaning and replacement. Note also that fasteners 13' could be in the form of Velcro or similar substitute. A bed pillow (not seen) can be placed atop pads 26 and 27 for greater comfort and cushioning effect if desired.

FIGS. 1 and 5 demonstrate the nature of fastener slots 31, 31' and how fasteners 13, 13' respectively can move therewithin, thereby allowing forehead support 25 to move as indicated by arrow 33, side support 12 to move as indicated by arrow 34 and side support 24 to move as indicated by arrow 34'.

While the drawings herein are not necessarily to exact scale, the invention has been described with reference to a specific embodiment, and various modifications of the embodiment, as well as other embodiments, may be used within the scope of the appended claims.

What is claimed is:

1. A device for supporting the abdomen, chest and head of a patient in an inclined prone position with the head of the patient facing downward, said device comprising:

a base, said base defining an aperture, said aperture affording a field of vision for the patient, said base extending approximately from the abdomen to the head of the patient, a strut, said strut attached to and depending from said base for inclining said base, and a plate, said plate mounted on said strut, said plate wider than said base to thereby prevent rotation of said base.

2. The device as claimed in claim 1, further comprising a facial support, said facial support adjustably attached to said base.

3. The device as claimed in claim 2 wherein said facial support comprises a plurality of resilient supports adapted to support the face of the patient.

4. A device as claimed in claim 2 wherein said facial support comprises a forehead support, a side support and a chin support.

5. A device as claimed in claim 1 further comprising a fastener, said fastener attached to said base.

6. A device as claimed in claim 5, further comprising a moisture-absorbent material, wherein said fastener clamps said moisture-absorbent material between said facial support and said base when said fastener is secured.

7. A device as claimed in claim 1, wherein said device is lightweight and has a mass less than 12 kg.

8. A device as claimed in claim 1 further comprising a cushion, said cushion mounted on said base for supporting the patient's upper body.

9. A device as claimed in claim 1 further comprising a plurality of cushions, said cushions mounted on said base for supporting the patient's upper body.

10. A device as claimed in claim 1 further comprising a facial support, said facial support comprising a forehead support, a side support and a chin support, and an adjusting member, said adjusting member movable longitudinally with respect to said base.

11. A device as claimed in claim 10 wherein said side support moves laterally with respect to said base.

12. A device for supporting the upper body of a patient in a prone position with the patient face down, said device comprising:

a planar base, said base defining an aperture, said base extending under the chest and abdomen of the patient;

a strut, said strut attached to said base and thereby inclining said base;

a plate, said plate attached to said strut and spaced from said base, whereby said plate prevents inadvertent rotation of said device; and a facial support, said facial support mounted on said base, said facial support adapted to support the face of the patient when the patient assumes a prone position.

13. A device as claimed in claim 12 further comprising means for absorbing moisture, said moisture absorbing means clamped between said facial support and said base.

14. A device as claimed in claim 12 wherein said facial support comprises a forehead support, a side support and a chin support.

15. A device as claimed in claim 12 wherein said facial support comprises a forehead support, a side support and a chin support, said device further comprising an adjusting member, said adjusting member movable longitudinally with respect to said base.

16. A method of facilitating convalescence of a patient required to remain in a prone position during an extended period of time, said method comprising:

a) providing an inclined base with an aperture therein;

b) providing a facial support;

c) clamping a moisture-absorptive material between said base and said facial support; and d) placing the patient in a prone position on said inclined base, where the patient's chest and abdomen are supported on said inclined base.

* * * * *